United States Patent [19]

Johnson

[11] 4,354,985

[45] Oct. 19, 1982

[54] WATER WASH HUMIDIFIER ASSEMBLY

[75] Inventor: Thomas Johnson, Williamstown, W. Va.

[73] Assignee: Skuttle Mfg. Co., Marietta, Ohio

[21] Appl. No.: 246,093

[22] Filed: Mar. 20, 1981

[51] Int. Cl.[3] ..... B01F 3/04

[52] U.S. Cl. ..... 261/100; 126/113; 261/DIG. 15; 261/DIG. 41

[58] Field of Search ..... 261/100, DIG. 15, DIG. 41, 261/103, 106; 126/113; 55/495, 504

[56] References Cited

U.S. PATENT DOCUMENTS

| | | | |
|---|---|---|---|
| 3,034,772 | 5/1962 | Schulz | 261/DIG. 41 |
| 3,047,994 | 8/1962 | Le Brun | 261/DIG. 41 |
| 3,203,157 | 8/1965 | Watlington | 55/495 |
| 3,599,942 | 8/1971 | Herr | 261/DIG. 15 |
| 3,689,037 | 9/1972 | Payne | 261/DIG. 15 |
| 3,770,254 | 11/1973 | Morrow | 261/DIG. 15 |
| 3,774,588 | 11/1973 | Yeagle | 261/DIG. 15 |
| 3,791,633 | 2/1974 | Lowe | 261/DIG. 15 |
| 3,823,926 | 7/1974 | Bracich | 55/504 X |
| 4,158,679 | 6/1979 | Yeagle | 261/106 |
| 4,237,080 | 12/1980 | Elliott | 261/DIG. 15 |

FOREIGN PATENT DOCUMENTS

| | | | |
|---|---|---|---|
| 324938 | 2/1930 | United Kingdom | 261/100 |

*Primary Examiner*—Richard L. Chiesa

*Attorney, Agent, or Firm*—Le Blanc, Nolan, Shur & Nies

[57] ABSTRACT

A humidifier assembly comprises a humidifier housing having an open bottom, a rear wall opening adapted to be aligned with an opening in ducting containing air to be humidified and a front wall opening over which is removably mounted a door. A removable water collection pan closes the open bottom of the housing. The pan removably mounts a wire frame carrying an evaporator pad that extends from the pan upwardly into the housing in the path of water discharged from a spray nozzle having a solenoid controlled valve mounted on the door. Air under pressure from the warm air plenum is introduced into the housing space between the nozzle and pad to pass through the wetted pad and discharge through the rear wall opening of the housing.

5 Claims, 7 Drawing Figures

Fig. 4
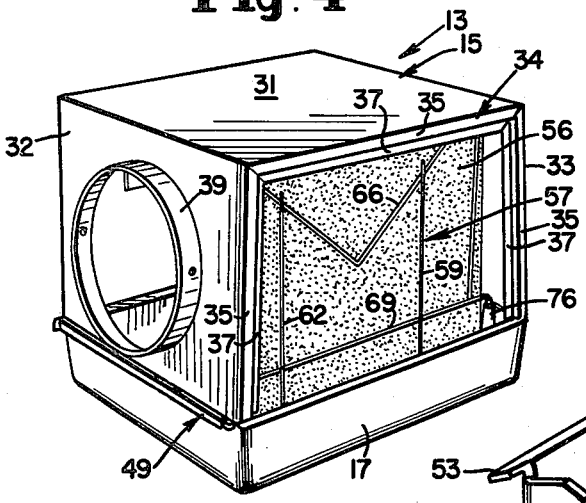
Fig. 7
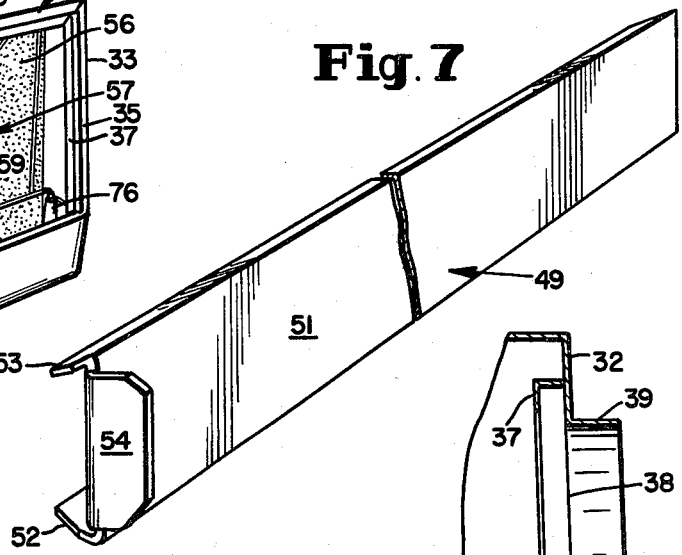
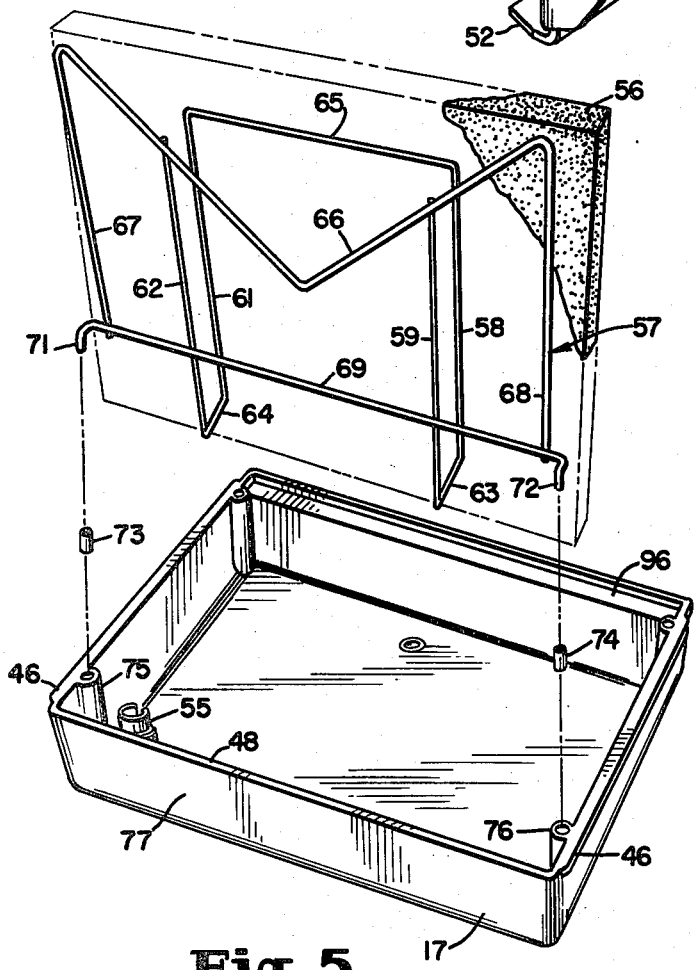
Fig. 5
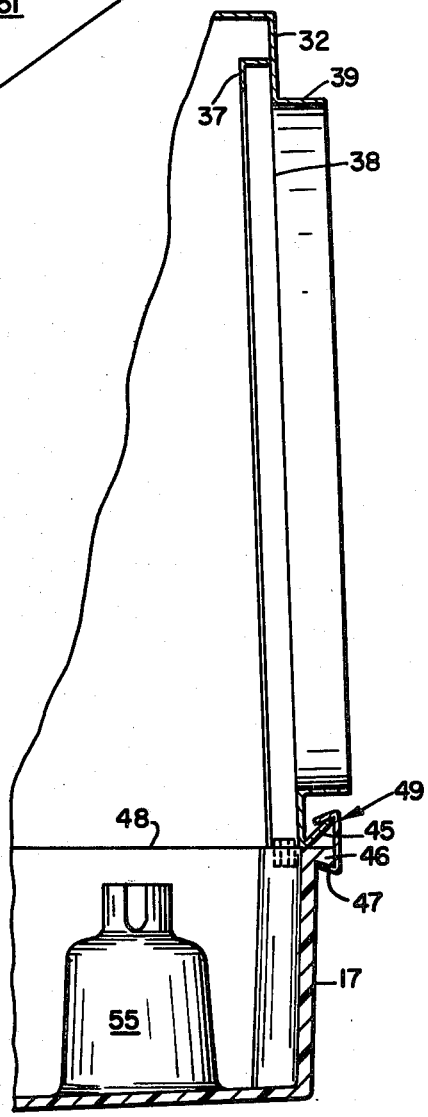
Fig. 6

WATER WASH HUMIDIFIER ASSEMBLY

This invention relates to humidifier assemblies particularly humidifier assemblies of the type wherein water is sprayed onto an evaporator pad through which is forced air to be humidified.

In its preferred embodiment the invention will be described as incorporated in a humidifier assembly mounted over an opening in the side wall of a return air plenum of a warm air furnace system, there being an evaporator pad in the humidifier adjacent the opening in the path of water sprayed from a door mounted solenoid valve controlled nozzle and with air being bypassed from the warm air plenum into the humidifier to pass through the wetted pad whereby moist air is discharged into the return plenum. The invention as will appear is mainly concerned with novel structure and mode of operation in the humidifier assembly, and this is the major object.

It is an important object of the invention to provide a novel humidifier assembly that is mounted to discharge moist air through an opening into ducting containing air to be humidified and comprising essentially a humidifier housing mounted on the ducting, a water collecting pan closing the bottom of the housing removably mounted on the housing and supporting an evaporator pad that projects upwardly adjacent the ducting opening, and a removable door on the housing mounting a solenoid valve controlled nozzle for spraying water on the pad, the door, pan and pad being removable from the assembly as for repair and replacement of parts while the housing is retained on the ducting.

A further object of the invention is to provide a novel door mounted spray nozzle arrangement in a humidifier.

Another object of the invention is to provide a novel mode of mounting an evaporator pad in a removable water collecting pan closing the bottom of a humidifier housing. Further to this object the pad is mounted upright in a novel wire frame having special support on the pan.

It is a further object of the invention to provide a novel spray type humidifier wherein a spray nozzle and its solenoid controlled valve are mounted on a removable front door of a humidifier housing.

A further object of the invention is to provide a novel structure for releasably mounting a water collection pan to close the open bottom of a humidifier housing wherein the housing extends over an evaporator pad extending up from the pad into the housing adjacent a rear wall opening of the housing and in the path of a spray nozzle on a removable door closing a front wall opening of the housing and resting at its lower end on the pan.

Further novel features and other objects of this invention will become apparent from the following detailed description, discussion and the appended claims taken in conjunction with the accompanying drawings.

BRIEF DESCRIPTION OF DRAWINGS

FIG. 4 is a generally perspective rear view showing the humidifier assembly aprt from the ducting;

FIG. 5 is an exploded view illustrating parts of the humidifier assembly, particularly the pan and pad arrangement;

FIG. 6 is a fragmentary section showing removable mounting of the pan on the humidifier housing; and FIG. 7 is a generally perspective view showing a slide member for retaining the pan suspended from the humidifier housing.

BRIEF DESCRIPTION OF INVENTION

Figure 1:
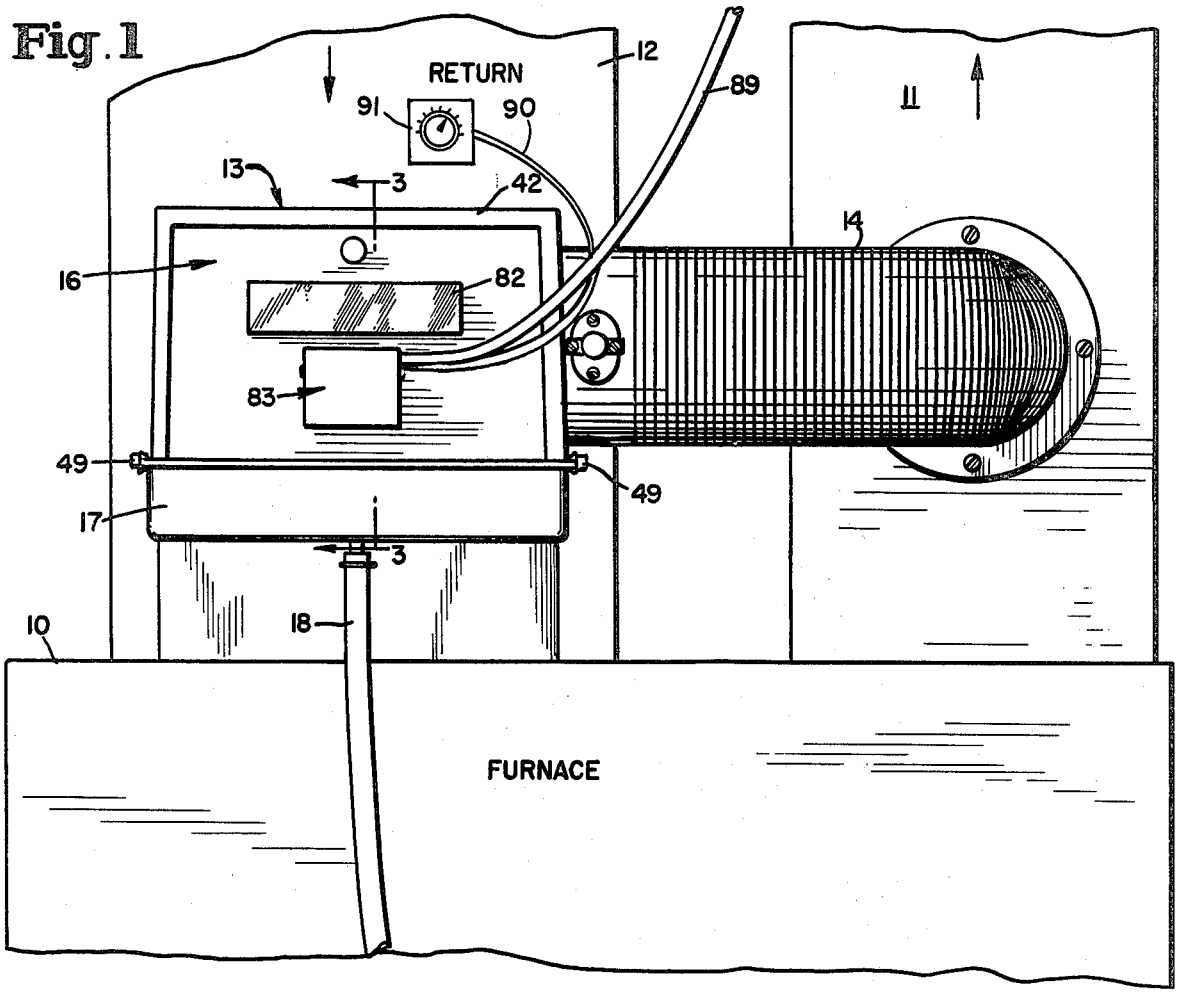
FIG. 1 is a fragmentary elevation showing a humidifier assembly mounted on the return plenum of warm air furnace ducting according to a preferred embodiment of the invention.

FIG. 1 illustrates a warm air furnace 10 connected to ducting in the form of a warm air supply plenum 11 and a cool air return plenum 12. A humidifier assembly 13 is mounted directly on the return plenum and is connected by a bypass tube 14 to the supply plenum. As shown the humidifier assembly includes a sheet metal or plastic housing 15, a front door assembly 16 and a water reservoir pan 17 that is removably mounted on the bottom of the housing. An open drain conduit 18 is provided for the pan.

The side wall of plenum 12 is formed with a rectangular opening 20 that is usually cut into the sheet metal wall of the plenum by the individual installing the humidifier assembly.

Figure 2:
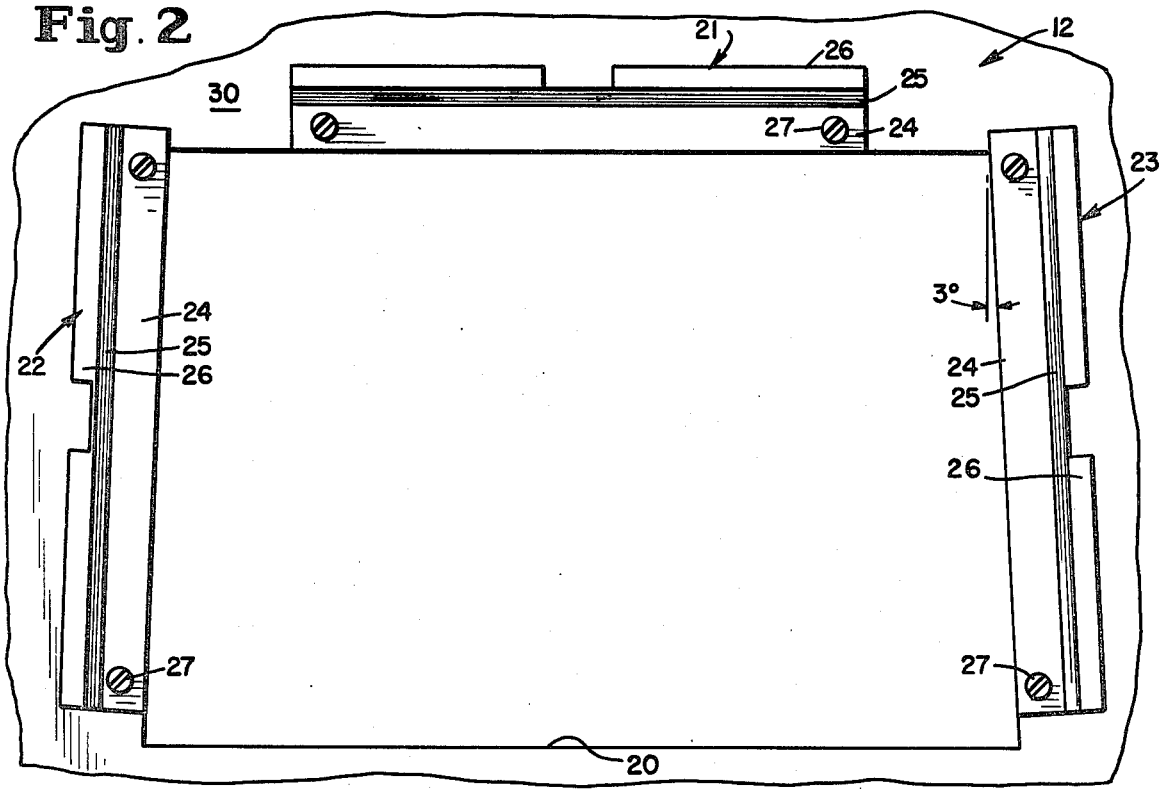
FIG. 2 is a somewhat enlarged fragmentary elevation showing the mounting for the humidifier on the plenum.
Figure 3:
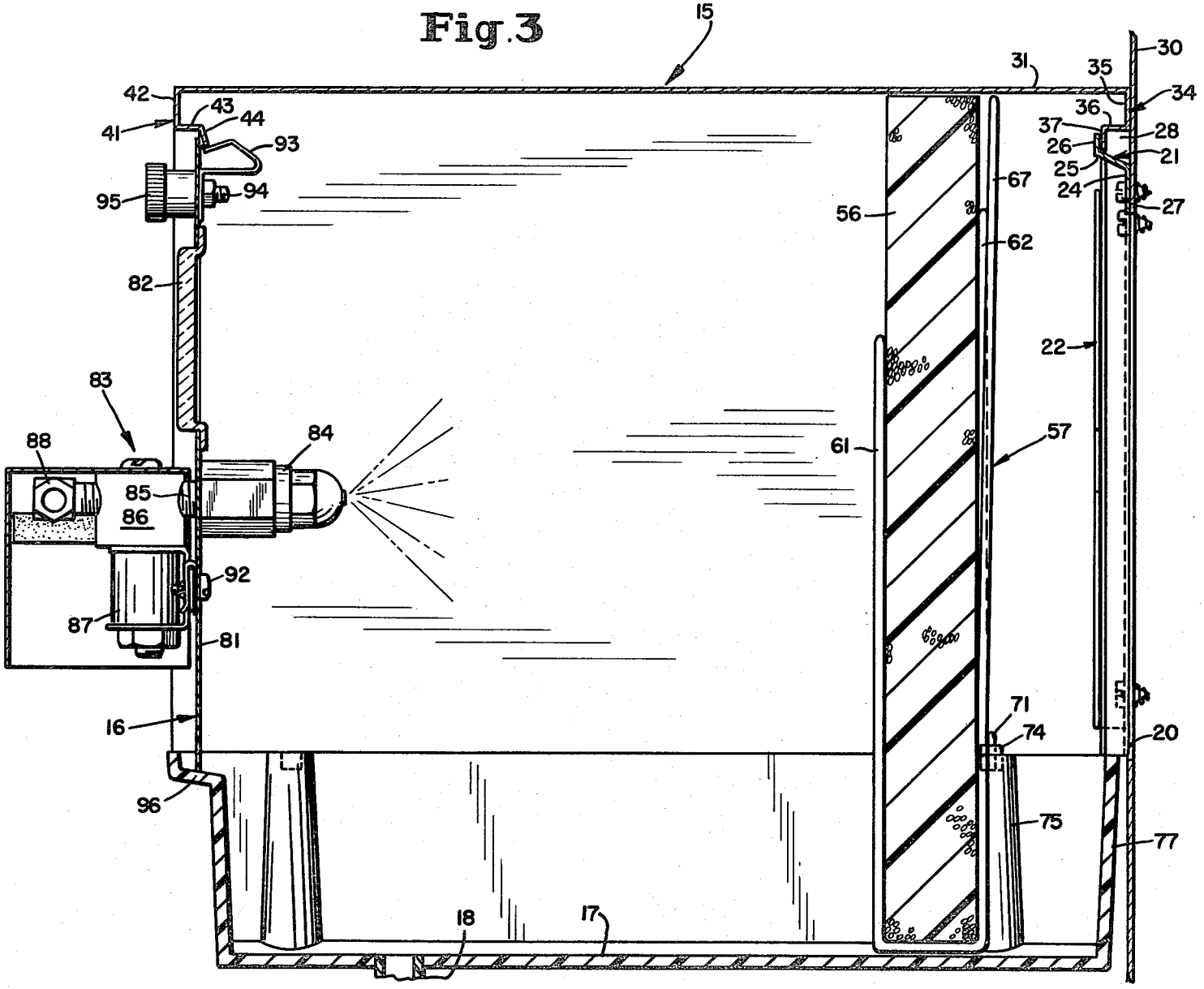
FIG. 3 is an enlarged section substantially on line 3—3 of FIG. 1 showing housing, pad, door assembly and pan detail.

As shown in FIG. 2 similar housing mounting sheet metal brackets 21, 22 and 23 are secured as by screws along the top and opposite side edges of opening 20. The cross sectional shape of each bracket is shown in FIG. 3 for bracket 21 which consists of a flat base 24 adapted to lie flush with plenum wall 30 along the edge of opening 20, and an inclined portion 25 extending away from the plenum wall and terminating in a flat end flange 26 parallel to the base. Screws 27 fix bracket 21 on the plenum wall. Bracket 21 thus defines an upwardly open socket indicated at 28 on the plenum wall.

Brackets 22 and 23 are similarly secured by screws 27 along the opposite side edges of opening 20 and define similar oppositely laterally facing open ended sockets along the plenum wall at opposite side edges of opening 20. Similar parts of brackets 22 and 23 are numbered similarly to bracket 21.

The humidifier housing 15 is generally U-shaped in lateral cross section as shown in FIG. 4, with an imperforate flat top wall 31, parallel opposite side walls 32 and 33 and an abbreviated rear wall 34 (FIG. 3). There is no botton wall on the housing. The rear wall 34 which defines a housing rear wall opening in alignment with ducting opening 20 is essentially an inward extension of the top and side walls and defines a U-shaped continuous bead 35 adapted to flatly abut the plenum wall as shown in FIG. 3. Around the inner edge of bead 35 is inwardly extending portion 36 terminating in a flat flange 37 parallel to bead 35, this flange thus being continuous along the inner edge of wall 34.

The housing 15 is mounted on the plenum by engaging the rear wall bead 35 with plenum wall 30 above opening 20 with the rear wall side flanges 37 aligned with the sockets defined by brackets 22 and 23, and then sliding the housing down until the top flange 37 seats in upper socket 28 as shown in FIG. 3. Bracket 21 limits downward movement of the housing and the brackets 21–23 combine to hold the housing 15 snugly on the plenum wall with the substantially open rear side of the housing aligned with plenum opening 20.

The mode of mounting the housing on the plenum wall may be that disclosed in Yeagle U.S. Pat. No. 3,774,588.

Housing side wall 33 may be imperforate, and side wall 34 is formed with an opening 38 surrounded by an outwardly projecting collar 39 upon which is mounted one end of bypass tube 14.

Referring to FIGS. 1 and 3, the front wall 41 of the housing is abbreviated similarly to the rear wall and comprises a U-shaped bead 42 extending along the top and opposite sides. As shown in FIG. 3 the inner edge of bead 42 has an inwardly extending portion 43 terminating in an inclined ledge 44 thus providing a U-shaped ledge 44 around the otherwise open front of the housing.

Housing 15 is preferably of sheet metal and along the lower edge of each side wall 32 and 33 (see FIG. 6) the wall is bent outwardly and upwardly to provide parallel inclined lips 45. The pan 17 which is preferably a molded integral unit of corrosion resistant synthetic plastic is formed along corresponding side edges with outwardly extending lips 45 having inclined bottom surfaces 47. The pan is so dimensioned that in the FIGS. 4 and 6 positions its upper edge 48 abuts the lower edges of housing 15 with lips 45 and 46 in adjacent alignment. Retainer strips 49 (FIG. 7) are slidably endwise mounted on the lips. Each strip 49 is a sheet metal or plastic element comprising a base 51 with upper and lower equally inclined lips 52 and 53 slidably fitting with the housing wall and pan edge lips. A tab 54 at one end of strip 49 facilitates sliding movement.

Retainer strips 49 comprise the sole means for holding the pan in assembly with the housing 15. Removal of the pan is accomplished by simply sliding both retainer strips 49 free, and then the pan (and any parts within it) is free to drop away from the housing which may remain on the plenum.

The mode of mounting the pan on the housing except for detail may be that disclosed in said Yeagle patent.

Pan 17 is formed with an integral hollow boss 55 defining an overflow tube that may be connected at its lower end to a redundant drain hose.

Mounted within the assembly is a pad 56 which is preferably a generally rectangular block of foamed open pore polyurethane of uniform thickness and preferably sized to extend laterally across substantially the entire interior of the housing 15 with its lower end in pan 17. Pad 56 is mounted parallel to the housing rear wall and preferably presents a planar surface area facing the door at least as large as the area of plenum opening 20.

Pad 56 is mounted upon pan 17 by means of a special unitary wire frame 57. Frame 57 comprises a pair of adjacent parallel vertical legs 58 and 59 laterally aligned with a similar pair of adjacent parallel vertical legs 61 and 62. Legs 58 and 59 lie in a common place where they are spaced apart the same distance as legs 61 and 62 which lie in a parallel plane. Legs 58 and 61 lie in a common plane where they are spaced apart the same distance as legs 59 and 62 which lie in a parallel plane. The lower ends of legs 58 and 59 are connected by a horizontal bar 63, and the lower ends of legs 61 and 62 are connected by a horizontal bar 64 parallel to bar 63. The upper ends of legs 58 and 61 are connected by a straight horizontal bar 65 extending at right angles thereto. A V-Shaped bar 66 extends between the upper ends of legs 59 and 62 substantially in the plane of those legs. The foregoing defines an open top upright frame channel of the approximate thickness of pad 56 and in which pad 56 is snugly mounted. The opposite ends of bar 66 extend beyond the legs and are turned down to provide spaced parallel vertical support bars 67 and 68. The lower ends of bars 67 and 68 are interconnected by a horizontal support bar 69 that is turned down at right angles at opposite ends to provide mounting pins 71 and 72.

As shown in FIG. 5, frame pins 71 and 72 extend through bushings 73 and 74 that line vertical bore bosses 75 and 76 integral with the pan side walls adjacent the pan rear wall 77.

The pad 56 is in the assembly is thereby removably mounted upright in pan 17 with its lower end disposed in pan 17 and its upper portion extending laterally across the housing 15 adjacent the rear wall opening of housing 15.

The door assembly 16 is a non-hinged removable assembly that closes the front wall opening of the housing. Door 15 comprises an upright metal sheet 81 having a transparent window 82 located above a combined solenoid valve and spray nozzle unit 83. The spray nozzle 84 which may be of any suitable type projects into housing 15 and is on the end of a conduit 85 containing a valve 86 adapted to be actuated by a solenoid 87 and terminates in a fitting 88 to which is connected a water supply pipe 89 (FIG. 1) for introducing water at mains pressure. The solenoid is connected by wiring 90 to a conventional suitably located remote control humidistat 91. The entire unit 83 is secured upon the door as by screws 92.

A latch system is mounted inside the upper end of the door. This comprises a U-shaped spring member 93 secured on the door by a bolt 94 that also mounts a pull handle 95 on the outer side of the door. The door is mounted in the assembly by resting its lower edge on a forwardly extending lip 96 that extends along the front wall of the pan and rocking the door clockwise in FIG. 3 until the flexible end of spring member 93 cams over housing ledge 44, at which time the upper and side edges of the door seat substantially against U-shaped ledge 44. The spring 93 in addition to retaining the upper end of the door on the housing also exerts a downward force helping seat the lower end of the door on the pan.

The door can thus be introduced into or removed from the assembly without detaching the pan 17.

The spray nozzle 94 is substantially centered with respect to the housing 15 and particularly with respect to the facing area of pad 56 that extends at right angles to the wide spray pattern. In operation when the nozzle is spraying water the pattern expands over substantially the facing area of the pad, the frame 57 offering little or no intercepting coverage so that the pad is wetted uniformly.

Air is extracted from plenum 11 which is at higher pressure than that in plenum 12 to pass through tube 14 into the interior of the housing intermediate the spray nozzle and the pad whereby the water spray is partly intermingled with and distributed into the incoming air.

As operation continues the pad stores water extracted from the wet air mass moving through it and ensures a uniform large area discharge of moist air into the return plenum. Should the amount of water sprayed on the pad exceed that required to moisten the air and saturate the pad the excess water collects in the pan 17 and may be drawn away through conduit 18.

The pad may be quickly replaced or serviced even by inexperienced persons merely by pulling out on handle 95 to lift the door away, and then sliding out the two retainer strips to drop out the pan. The valve and nozzle assembly may be replaced or serviced while the pan and pad remain on the housing.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a humidifier assembly comprising a humidifier housing having an open bottom, a rear wall opening adapted to be aligned with an opening in ducting containing air to be humidified and a front wall opening over which is mounted an openable door; a water collection pan removably mounted on the housing to close said bottom of said housing, a retaining frame removably mounted in socket means on said pan, said frame being a unitary wire frame forming an open top channel structure, an essentially flat block of substantially uniform thickness synthetic plastic material mounted in said frame and extending from said pan upwardly into said housing adjacent said rear wall opening and extending at least across the area of said opening, said frame having portions engagable with the opposite sides of said pad to support said pad against collapse or distortion, a spray nozzle having a remotely controlled valve mounted on said door and arranged to spray water onto said pad, and means in the wall of said housing for admitting air under pressure into the space between said nozzle and said pad to pass through said pad and discharge through said rear wall opening of the housing.

2. In the humidifier assembly defined in claim 1, said frame having spaced lower end portions slidable into vertical bore socket formations on said pan.

3. In the humidifier assembly defined in claim 1, said pan having an overflow outlet for draining excess water therefrom.

4. In the humidifier assembly defined in claim 1, said means for introducing air under pressure comprising a conduit connected to a side wall opening of said housing.

5. The humidifier assembly of claim 4 in combination with a warm air furnace having a return air plenum provided with an opening over which said humidifier assembly is mounted and a bypass conduit for introducing air from a warm air supply plenum into said housing.

* * * * *